US006610368B2

(12) United States Patent
Schmitz et al.

(10) Patent No.: US 6,610,368 B2
(45) Date of Patent: Aug. 26, 2003

(54) LEATHER AND A METHOD OF DRESSING SAME

(75) Inventors: Werner Schmitz, Kronberg (DE); Gottfried Holzer, Krems (AT); Wolfgang Vogl, Mattighofen (AT)

(73) Assignee: Lederfabrik Vogl GmbH, Mattighofen (AT)

( * ) Notice: Subject to any disclaimer, the term of this patent is extended or adjusted under 35 U.S.C. 154(b) by 0 days.

(21) Appl. No.: 09/821,878

(22) Filed: Mar. 29, 2001

(65) Prior Publication Data

US 2002/0020024 A1 Feb. 21, 2002

(30) Foreign Application Priority Data

Mar. 30, 2000 (DE) ..... 100 15 555

(51) Int. Cl.[7] ..... B05D 1/12; B05D 1/02; B05D 3/06; B05D 7/12; C23C 4/12; H05H 1/24

(52) U.S. Cl. ..... 427/447; 427/536; 427/537; 427/569; 427/576; 427/578; 427/453; 427/563; 427/564

(58) Field of Search ..... 437/534, 536, 437/569, 576, 578, 579, 491, 489, 538, 447, 446, 453, 454, 537, 562, 563, 564

(56) References Cited

U.S. PATENT DOCUMENTS 3,784,396 A * 1/1974 Fourment et al.
5,026,463 A * 6/1991 Dinter et al.
5,160,592 A * 11/1992 Spitsin et al. ..... 427/538
5,288,809 A * 2/1994 Christner et al. ..... 427/447
5,523,118 A * 6/1996 Williams ..... 427/536
5,578,348 A * 11/1996 Bauer et al. ..... 427/447
5,629,402 A * 5/1997 Pedain et al. ..... 427/393.4
5,658,484 A * 8/1997 Lohmann et al. ..... 8/94.1 R
5,674,558 A * 10/1997 Speer ..... 427/140
5,770,264 A * 6/1998 Münzmay et al. ..... 427/323
5,834,384 A * 11/1998 Cohen et al. ..... 427/538
5,843,789 A * 12/1998 Nomura et al. ..... 427/488
5,895,558 A * 4/1999 Spence ..... 427/569
6,284,836 B1 * 9/2001 Hassel et al. ..... 427/372.2
6,287,642 B1 * 9/2001 Leutsch et al. ..... 427/536
2001/0038919 A1 * 11/2001 Berry, III et al. ..... 427/488

FOREIGN PATENT DOCUMENTS

| | | | |
|---|---|---|---|
| DE | 41 16 872 A | | 11/1992 |
| EP | 0 238 991 | | 9/1987 |
| JP | 58054000 A | * | 3/1983 |
| RU | 1 483 957 | | 1/1999 |

OTHER PUBLICATIONS

*Hawley's Cóndensed Chemical Dictonary*, 12th ed., Revised by R.J. Lewis, Sr.; Van Nostrand Reinhold Co., N.Y., excupt. p. 693–694, 1993 No month.*

Translation of JP 58–054,000 A to Keiho Ishida, Mar. 30, 1983.*

* cited by examiner

*Primary Examiner*—Marianne Padgett
(74) *Attorney, Agent, or Firm*—Herbert Dubno

(57) ABSTRACT

Tanned leather is dry dressed by plasma deposition at atmospheric pressure of a matrix material such as ITO, a silicone, or polyurethane, upon the protein fibers of the surface of the leather and the collagen fiber skeleton below the surface protein fibers. The leather retains its toughness, elasticity, breathability and softness or hand.

9 Claims, 1 Drawing Sheet

LEATHER AND A METHOD OF DRESSING SAME

FIELD OF THE INVENTION

The present invention relates to a new type of dressed leather and to a dressing method which can impart special characteristics to a tanned leather. In particular the invention is directed to leather of all types for use over the entire spectrum of leather applications and improves the surface properties of the leather without interfering with the porosity thereof.

BACKGROUND OF THE INVENTION

In the tanning of leather the proteins and collagen of the skin are transformed into durable compounds without detriment to the typical characteristics of leather such as its toughness, elasticity, breathability and like properties.

The leather, after tanning, can be subjected to a so-called dressing in which the leather surface is largely protected from chemical and mechanical effects and which can ensure a uniform color and brightness over the entire leather surface to thereby enhance especially the optical and handling characteristics of the leather. As a general matter, the dressing step serves to enhance the value of the leather and the fields in which the leather can be used. In the past, the dressing operations have involved wet steps which, for example have required the spraying of appropriate substances onto the leather and a drawback of all of these processes is that the leather must be subjected to drying at the conclusion of the process. A drying step usually must follow every spraying step.

While the wet processes have served to increase the quality of the leather in some ways, they have a tendency to reduce the breathability of the leather which is one of the most important advantages of it.

Dressing of leather as practiced heretofore has also shown that the modified leather does not benefit only from improved properties. In fact, the conventionally dressed lather should have improved UV resistance and a reduced tendency towards evaporation of fats contained in the leather and thus the so-called fogging effect. In the past these effects could be avoided by replacing more volatile plasticizers with less volatile compounds. As a result of the diffusion of the fat content of the skin at higher temperatures, the leather tended to become brittle and that suppressed the durability of the leather unless the leather was subject to intensive maintenance.

OBJECTS OF THE INVENTION

It is the principal object of the present invention to provide an improved leather which is free from the disadvantages mentioned previously.

Another object of this invention is to provide a leather which suffers from less loss of fats and thus has greater durability without maintenance and does not suffer from significant loss of breathability.

It is also an object of this invention to provide a leather with advantageous properties which can be manufactured or dressed in a simple manner and which will have a greater range of applications and enhanced useful life.

It is also an object of the invention to provide a method of improving or dressing a leather having a porous surface layer of protein fibers on a collagen fiber skeleton which will produce a dressed leather without the disadvantages noted and which can be carried out in a simple manner.

SUMMARY OF THE INVENTION

These objects and others which will become apparent hereinafter are attained, in accordance with the invention with a tanned leather having a porous surface layer of protein fibers on a collagen fiber skeleton and wherein the protein fibers and underlying collagen structure have protective-coating layers leaving open pores thereof.

The method of the invention can comprise the steps of:

- providing the tanned leather having the porous surface layer of protein fibers on the collagen fiber skeleton as a substrate in an atmospheric-plasma coating reactor;
- dispersing a matrix material in the reactor in a coating atmospheric plasma; and
- depositing the matrix material in a plasma coating at atmospheric pressure on the substrate to form protective-coating layers on and in the protein fibers and underlying collagen structure at high energy while leaving open pores thereof.

The surface of the leather and the collagen skeleton is thus provided with a protective coating layer while the pores thereof remain open and unblocked. The surface of the leather is comprised of a layer of protein fibers while therebelow lies a collagen structure which is comprised of collagen fibers which cross each other nonuniformly and transversely to one another. As a consequence, the skeleton is coherent over the entire width of the leather. The invention appears to coat the protein fibers at the surface with the protective layer, for example of silicone or polyurethane without causing the fibers to additionally stick together and without restricting the breathability of the surface. The same holds true for the fibers of the collagen skeleton. The dressing is carried out by a plasma coating at atmospheric pressure. Apparently the plasma coating method results at least in part in an application of the matrix material, for example silicone and/or polyurethane, into the fiber and the leather structure without a significant increase in the volume of the leather, the coating thicknesses lying in the nanometer range. The coatings of the protein fibers on the surface as well as on the fibers of the collagen skeleton serve as diffusion barriers.

For the implantation and coating, the leather is treated by standard dry plasma coating techniques. It is indeed surprising that in the treatment of tanned leather as a substrate with gases ionized gas produced by electric discharge i.e. the plasma under atmospheric pressure the deposition of the matrix particles can be effected on the surface of the leather, i.e. upon the individual protein fibers and on the underlying collagen skeleton so that these fibers are sheathed by the matrix material and the matrix material are implanted in the collagen skeleton. The matrix particles can be comprised preferably of silicone or polyurethane to achieve the desired results with the leather, although depending upon the materials deposited, single functional or multifunctional coatings can be provided.

For example, $SiO_2$, $TiO_2$, polyurethane (PU), silicones and titanium oxide doped with indium (ITO) can be used as UV protectors. Other functions can be provided with such coatings as well. They can increase the chafing resistance of the leather, the handling thereof can serve as diffusion barriers (antifogging), as coatings preventing the pickup of dirt and coatings reducing the sensitivity to moisture.

The extraorindarily thin layers which are produced on the leather fibers do not affect the optical and natural characteristics of the leather like the breathability or the softness or hand thereof. The collagen skeleton appears as an irregular fiber fleece which, unlike textile fleeces, is nevertheless coherent. Each skeleton fiber can be coated and particles can be implanted in the fibers themselves without closing the skeleton structure or sealing it in any way.

The dressing operation according to the invention has the advantage that it is carried out dry and does not have the main drawback of the wet processing of the prior art in that a subsequent drying is necessary. The dry dressing of the invention does not alter the hand or feel of the leather substrate or its breathability, unlike the wet processes.

The plasma treatment of the invention has the further advantage that the thin fiber coating is applied not only to surface fibers of the substrate but throughout the skeleton underlying the same. Furthermore, the dressing process of the invention is energy conserving in that no water is used and thus there is an energy saving with respect to the drying, the treatment of the water, etc.

The matrix particles are implanted in part in the fibers because the matrix particles impinge upon the fibers with high kinetic energy and, in the case of turbulence in the gas stream, in random directions. It has been found to be advantageous to superimpose on the voltage field of the plasma reactor at atmospheric pressure, a pulsed voltage wherein the frequency of the individual pulses is in the ultrasonic range and the pulses have peak voltages in the kiloelectronvolt range. The pulses can have the same polarity.

The atmospheric pressure plasma can use atmospheric air as the plasma gas or a mixture thereof with other gases and, since the treatment is carried out at atmospheric pressure and with a gas discharge, it is possible to utilize a multiplicity of plasma burners or plasma guns. The matrix material can be supplied as a powder or in liquid form to the gas stream and is atomized by and carried in the plasma stream and applied at high energy to the substrate.

The turbulence imparted to the matrix particles has been found to cause them to contact and deposit on all surfaces of the fibers regardless of their orientation and thus to implant in and form sheaths around the fibers. The matrix material does not aggregate except in the form of thin coating and thus the gas remains gas and the solids remain solids as they are applied to the fibers. When the solid material deposits, however, they form the coating previously described. The atomization requires only a limited amount of energy and does not functionally alter the characteristics of the deposited materials either. This is very important to the invention especially where the matrix materials and the coating are to be multifunctioning.

The tanning of the animal skin provides a leather substrate of which only the reticular layer and the papillary layer are dressed. The skin can have a collagen skeleton which is more or less dense but usually is generally uniform. The collagen mesh is also coated with the matrix particles and in part penetrated thereby so that the chemical characteristics of the leather are altered while the breathing characteristics are maintained. The result is a high quality leather which was not obtainable heretofore. The choice of the reaction gases on the one hand and the matrix materials on the other and in association with the particular tanned leather to be treated allows a wide variety of products to be treated. The leather is protected against UV radiation and is resistant to evaporation of fats. The hand or softness of the leather is not diminished since the fats remain in the leather. The leather can be used even at high temperature, for example, for automotive interiors without becoming brittle or streaking. The resistance to chafing is likewise enhanced and cleaning is simplified.

The leather can be used for all purposes that conventional leather has been employed in the past and can be used in place of synthetic leather without concern as to the contribution of carbon dioxide to the environment, synthetic leather being a petroleum derivative which upon decomposition produces carbon dioxide. Natural leather treated in accordance with the invention is largely carbon dioxide neutral.

The preprogramming of different substrate characteristics by the choice of suitable reaction gases and matrix materials enables the leather dressed in accordance with the invention to have antifungal and antibacterial properties so that the leather can also be used in health related fields. The leather substrate can be activated or cleaned in the plasma chamber utilizing a plasma if desired.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
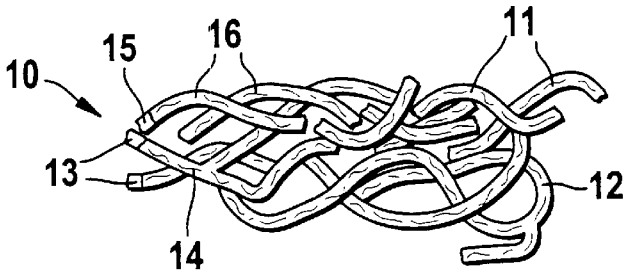
FIG. 1 is a diagram showing the principles of the invention.
Figure 2:
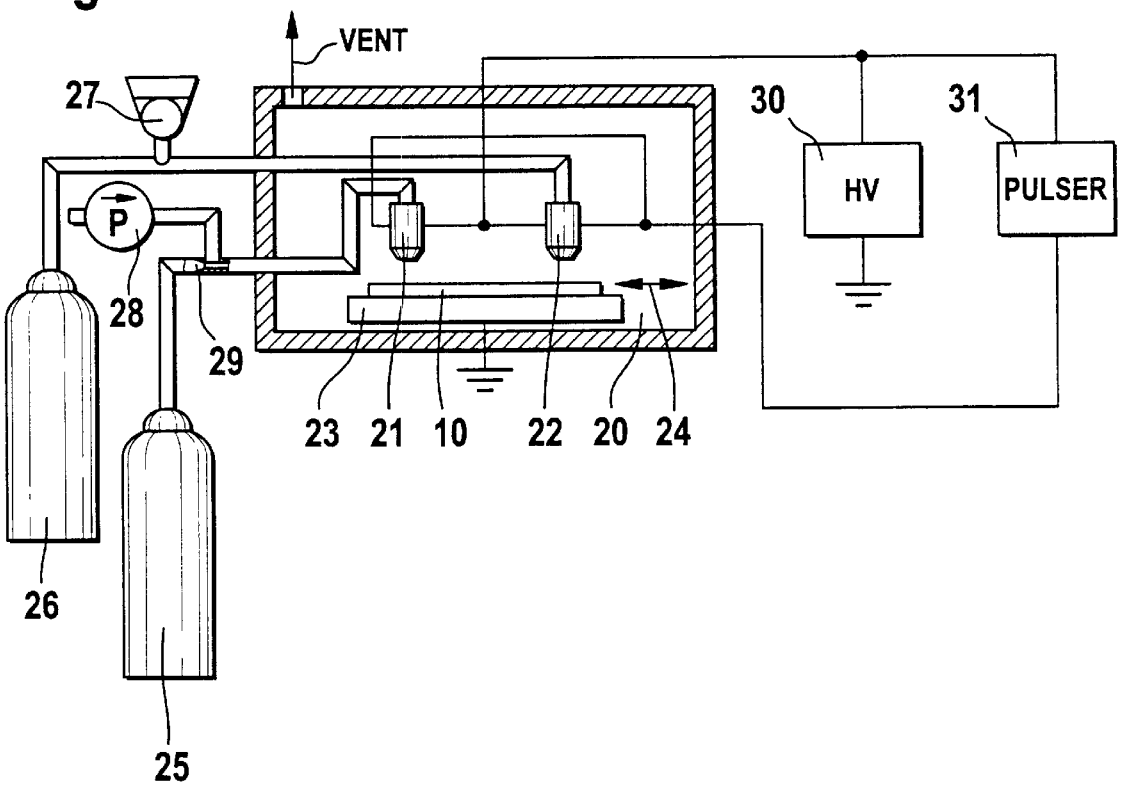
FIG. 2 is a diagram illustrating an apparatus for carrying out the method of the invention.

In FIG. 1 there is shown the collagen skeleton 12 and the overlying protein fiber layer 11 of a leather substrate 10 in which the collagen fibers 13 have been coated at 14 with a nanometer thick coating of ITO, polyurethane or a silicone in a plasma process. The protein fibers 15 are likewise coated at 16 with these materials. The coating can be effected in a reaction chamber 20 by plasma guns 21 and 22 which are displaced relative to the substrate holder 23 as represented by the double headed arrow 24, so that the plasmas from the plasma guns are swept uniformly over the entire surface of the leather substrate 10. The plasma guns 21 and 22 are supplied with the reaction gases from tanks 25 and 26 and, after an initial plasma cleaning of the substrate or activation of the surface thereof without the addition of particles, particles are supplied to the plasma gas streams. The hopper 27, for example, supplies a pulverulent matrix material to one of the plasma burners 22 while a liquid is supplied by a pump 28 and a venturi 29 to the plasma burner 21. The gases atomize the matrix material before it is applied to the substrate in the plasma stream. The plasma is maintained by a high voltage source 30 and on the plasma voltage, a pulser 31 superimposes pulses each of which is of a frequency in the ultrasonic range and has peak voltage levels in the kilo electron volt range.

We claim:

1. A method of treating a tanned leather having a porous surface layer of protein fibers on a collagen fiber skeleton so that said leather has open pores, the method comprising the steps of:

providing the tanned leather having said porous surface layer of protein fibers on said collagen fiber skeleton as a substrate in an atmospheric plasma coating reactor;

dispersing a matrix material, which is to be deposited without chemical modification on said surface, in said reactor in a coating atmospheric plasma in the form of liquid or solid particles of said material; and depositing said matrix material in a plasma coating at atmospheric pressure on said substrate without chemical modification of the matrix material to form coating layers on and in the protein fibers and the collagen fiber skeleton while leaving open pores thereof.

2. The method defined in claim 1 wherein said tanned leather is coated on a surface thereof activated by an inert reaction gas in said reactor.

3. The method defined in claim 1 wherein a surface of the tanned leather to be coated is cleaned with an inert reaction gas in said reactor.

4. The method defined in claim 1 wherein said matrix material includes a silicone.

5. The method defined in claim 1 wherein said matrix material includes polyurethane.

6. The method defined in claim 1 wherein the matrix material includes indium-doped titanium oxide.

7. The method defined in claim 1 wherein said matrix material is introduced as the liquid into a gas stream into said reactor.

8. The method defined in claim 1 wherein said matrix material is introduced as the solid particles into a gas stream in said reactor.

9. The method as defined in claim 1 wherein said matrix material is deposited on said substrate from the plasma which is maintained by a voltage field, the method further comprising the step of superimposing on said voltage field a pulsed voltage with a frequency of individual pulses in an ultrasonic range and a peak voltage in a range of about 1000 electron volts.

* * * * *